United States Patent [19]

Dahlin et al.

[11] Patent Number: 4,988,257

[45] Date of Patent: Jan. 29, 1991

[54] DEVICE FOR HANDLING REFUSE

[75] Inventors: Ingemar Dahlin, Blomstermåla; Roger Lagerqvist, Mönsterås, both of Sweden

[73] Assignee: Norba AB, Blomstermala, Sweden

[21] Appl. No.: 396,426

[22] Filed: Aug. 21, 1989

[30] Foreign Application Priority Data

Sep. 7, 1988 [SE] Sweden ..... 8803136

[51] Int. Cl.[5] ..... B65F 3/04

[52] U.S. Cl. ..... 414/420; 414/409; 414/421

[58] Field of Search ..... 414/303, 406–409, 414/419–421

[56] References Cited

U.S. PATENT DOCUMENTS

| | | | |
|---|---|---|---|
| 3,127,039 | 3/1964 | Christiansen | 414/420 |
| 3,136,436 | 6/1964 | Erlinder et al. | 414/409 |
| 3,148,793 | 9/1964 | Walter | 414/409 |

FOREIGN PATENT DOCUMENTS

| | | | |
|---|---|---|---|
| 66368 | 9/1950 | Netherlands | 414/407 |
| 933559 | 6/1982 | U.S.S.R. | 414/407 |
| 1265099 | 10/1986 | U.S.S.R. | 414/421 |

*Primary Examiner*—David A. Bucci

[57] ABSTRACT

A refuse handling device for moving a refuse receptacle (12) between a lower level and a higher level and for emptying the receptacle at the higher level by tipping the receptacle, includes a cradle (11) for carrying a receptacle. A driving arrangement (9) lifts and lowers the cradle and also a device (31) for turning the cradle between an upright receptacle position and a receptacle emptying position. The cradle (11) is carried by an axle, which may be raised and lowered transverse to its longitudinal direction and which is rotatable. At its ends the axle has wheels (8), which are non-rotatably connected to the axle. Each of the wheels is rotatably journalled in a respective car (6, 7) for running in a respective elongated guide device (25). The cars are driven by a driving arrangement (9) by it being subjected to a force which is directed mainly in the longitudinal direction of the guide arrangement, thereby causing the lifting and lowering motion. Each of the wheels is in contact with the respective track, which extends along the associated guide arrangement and is forced to rotate by the effect of the force on the cars for rotating the axle during its lifting and lowering motion.

6 Claims, 8 Drawing Sheets

DEVICE FOR HANDLING REFUSE

FIELD OF THE INVENTION

The present invention relates to a refuse handling device for moving refuse receptacles between a lower level and a higher level, and for emptying the receptacles at the higher level by tipping the respective receptacle.

BACKGROUND ART

Lifting devices for refuse receptacles are previously known and are generally intended for mounting on refuse collection vehicles for picking up refuse at several places and emptying it at a refuse station. It is thus important that the region for lifting and emptying the refuse receptacles be as free as possible from lifting mechanisms and the like in order to achieve the greatest possible degree of flexibility when it comes to, e.g., the possibility of changing between different handling systems, such as, e.g., loading of garbage sacks or, as in the present case, emptying of receptacles. For this reason, driving arrangements for lifting and tipping receptacles have typically been mounted on the sides of the vehicle, normally as double devices, with one device on either side of the opening into which the refuse is dumped. Since the opening through which the refuse is dumped is generally relatively wide, the driving devices are thereby placed relatively far from each other, which, when using hydraulically or pneumatically driven power devices, leads to difficulties in achieving a synchronous, smooth lifting motion. In order to reduce these problems as much as possible it has previously been necessary to design the lifting mechanism to be very sturdy, especially in regards to the cradle for lifting and tipping the receptacle and its associated guides, in order to achieve a device which is as stable and has as great a torsional stiffness as possible. As a result of this, these previously known solutions require a relatively great deal of room and are heavy, and are consequently both cumbersome and expensive.

TECHNICAL PROBLEM

The object of the present invention is to provide a device requiring little space which provides a smooth lifting motion and which includes both a lifting and a tipping motion.

SUMMARY OF THE INVENTION

The stated object is achieved by means of a device according to the present invention, whose characteristics are given below.

BRIEF DESCRIPTION OF THE DRAWINGS

The invention will be described below in greater detail using an exemplifying embodiment and with reference to the accompanying drawings, in which.

DESCRIPTION OF THE PREFERRED EMBODIMENTS

Figure 1:
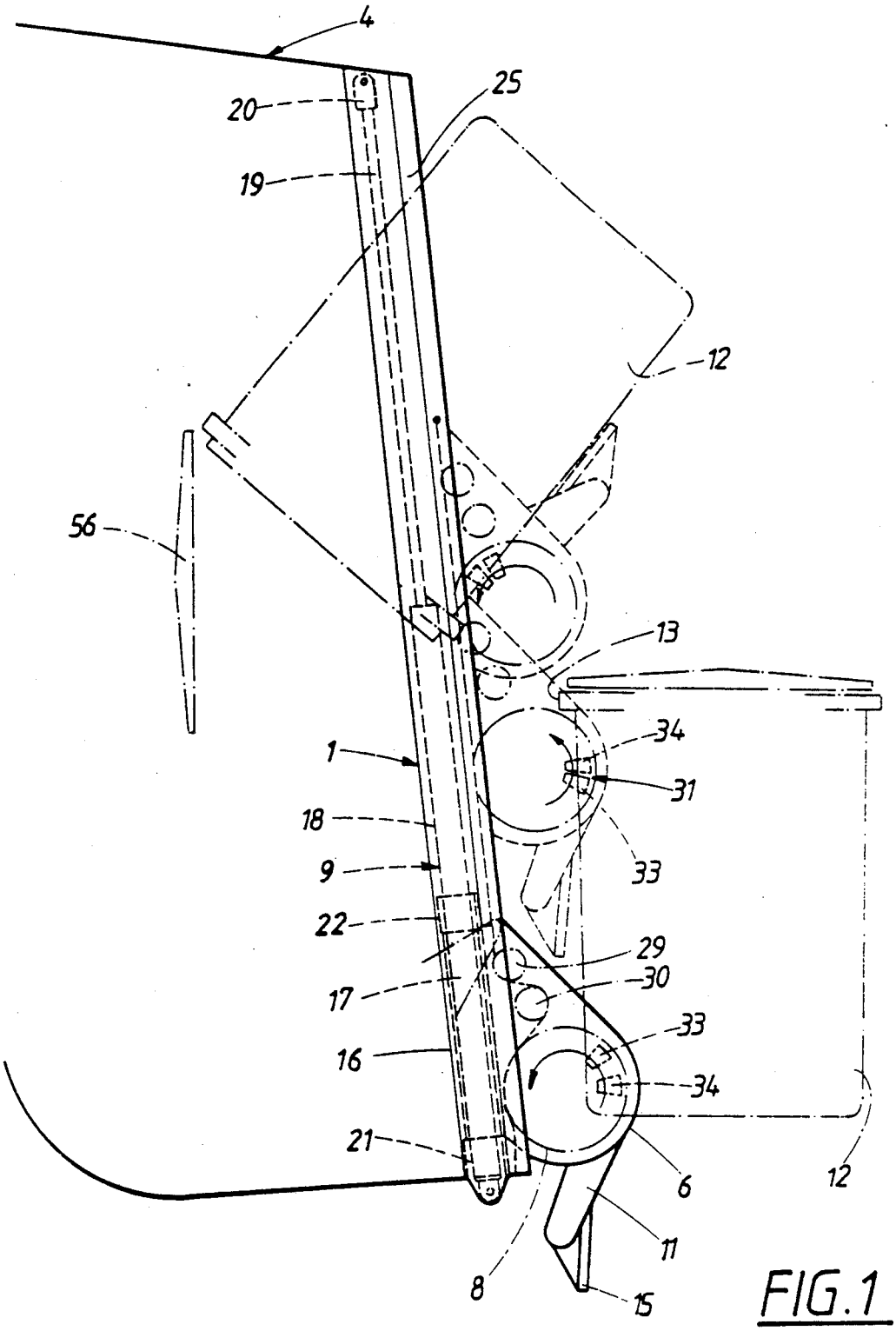
FIG. 1 is schematic side view of the device according to the invention.
Figure 2:
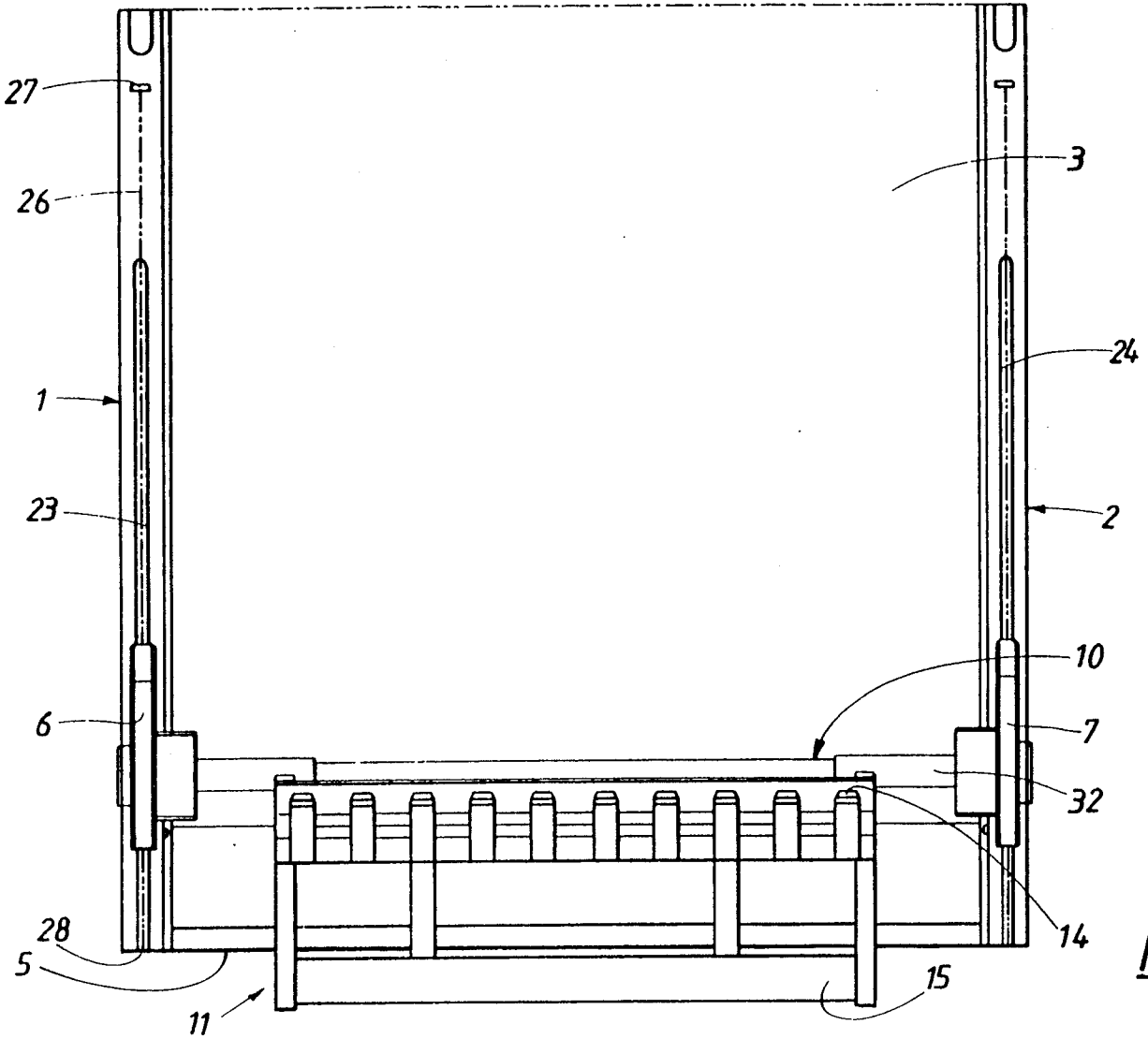
FIG. 2 is a rear view of the device.

As is best seen in FIGS. 1 and 2, the device according to the invention is built up of two upright units 1, 2, which are disposed at a distance from one another. The upright units 1,2 are intended to be fastened securely, one on either side of an emptying opening 3 of a refuse container 4. The refuse container 4 may for example be the container of refuse collection vehicle. The two upright units 1, 2 are preferably fixed relative to one another at their lower portions by means of a cross beam 5 so that the upright units are maintained parallel to one another with a predetermined separation. At least one of the upright units includes a driving device for driving two cars 6, 7, one for each of the upright units, along the upright units, whereby each car includes a wheel 8. In FIG. 1 the same car 6 is shown in different vertical positions on its corresponding upright unit. The said driving device consists of a piston/cylinder arrangement 9, which is secured at its one end in the upright unit and is arranged, by means of its expansion and contraction motions, to move the cars 6, 7 along the respective upright unit 1 and 2 by the cars being joined with the movable member of the respective piston/cylinder, which is thus not rigidly fastened to the upright unit, but is provided to move within it.

The device according to the invention includes a cross-axle 10, which extends between the two upright units 1, 2. The cross-axle is rotatably journalled at its ends in the two cars 6, 7 and mounts the two wheels 8, which are securely and non-rotatably mounted on both ends of the axle. The wheels 8 are thus arranged to rotate together with the axle 10. The axle 10 carries a cradle 11, which in turn is intended to carry at least one receptacle 12. The device according to the invention is thus intended to lift and empty the contents of the receptacle into the refuse collection container 2. The cradle 11 may be of a known type adapted to the type of receptacle to be used for the given emptying technique, namely, a receptacle with a flange 13 which extends downwards along at least the rear edge of the receptacle, whereby upwardly extending gripping claws 14 on the cradle may grip under the flange. The cradle also includes a lower receptacle support 15 in the shape of a cross boom and an arrangement, which may be of a known type and which is not shown in further detail, for securing the receptacle upward at its downward pointing flange 13.

Having decribed the principle construction of the device, the devices which cause the lifting, tipping and lowering of the receptacle will now be described in greater detail.

The upright units 1, 2 consist of tubular units having a suitable cylindrical shape. The upright units have an outer tube 16 whose cylindrical inner surface forms a guide for an inner tube 17. The inner tube 17 is securely fastened on the movable member of the piston/cylinder 9, in this case the piston member 18, whereby the piston rod member 19 of the piston/cylinder is anchored at its upper end 20 in the outer tube 16. At each end of the inner tube 17 it has a gliding lining 21, 22 of a suitable material having low friction, e.g., a plastic material, to permit gliding contact between the gliding lining and the inner wall of the outer tube. It is assumed below that each of the upright units 1, 2 has a driving device formed of a piston/cylinder 9, whereby each of the cars is securely fastened to the inner tube 17. It is, however, conceivable to leave out the piston/cylinder arrangement in the one upright unit. A portion of each of the cars 6, 7 extends through a respective longitudinal slit 23, 24 provided in each outer tube 16, whereby the slits are surrounded by two guiding flanges 25 (se FIG. 1), which form guides for guiding the cars when they move along the upright units 1, 2.

The cars 6, 7 are formed as housings or hoods, in which the axle 10, and thereby also the wheels 8, are rotatably journalled. In the illustrated example, the wheels 8 are formed as sprockets, which are provided to engage an immovable drive track 25, which extends along the greater part of the length of the upright units 1, 2. The drive track 25 in the illustrated example is formed of a chain, which is fastened at each end 27, 28. The sprockets engage the chain and are thereby driven by it and are caused to rotate by the linear motion of the cars 6, 7 by the action of the piston/cylinders 9, as will be described further below. As is shown in FIG. 1, the longest possible engagement distance between these sprockets 8 and the chain is ensured by means of two breaker wheels 29, 30, which ar rotatably journalled in each of the cars and are provided to redirect the chain in the manner shown in the figure.

Figure 6:
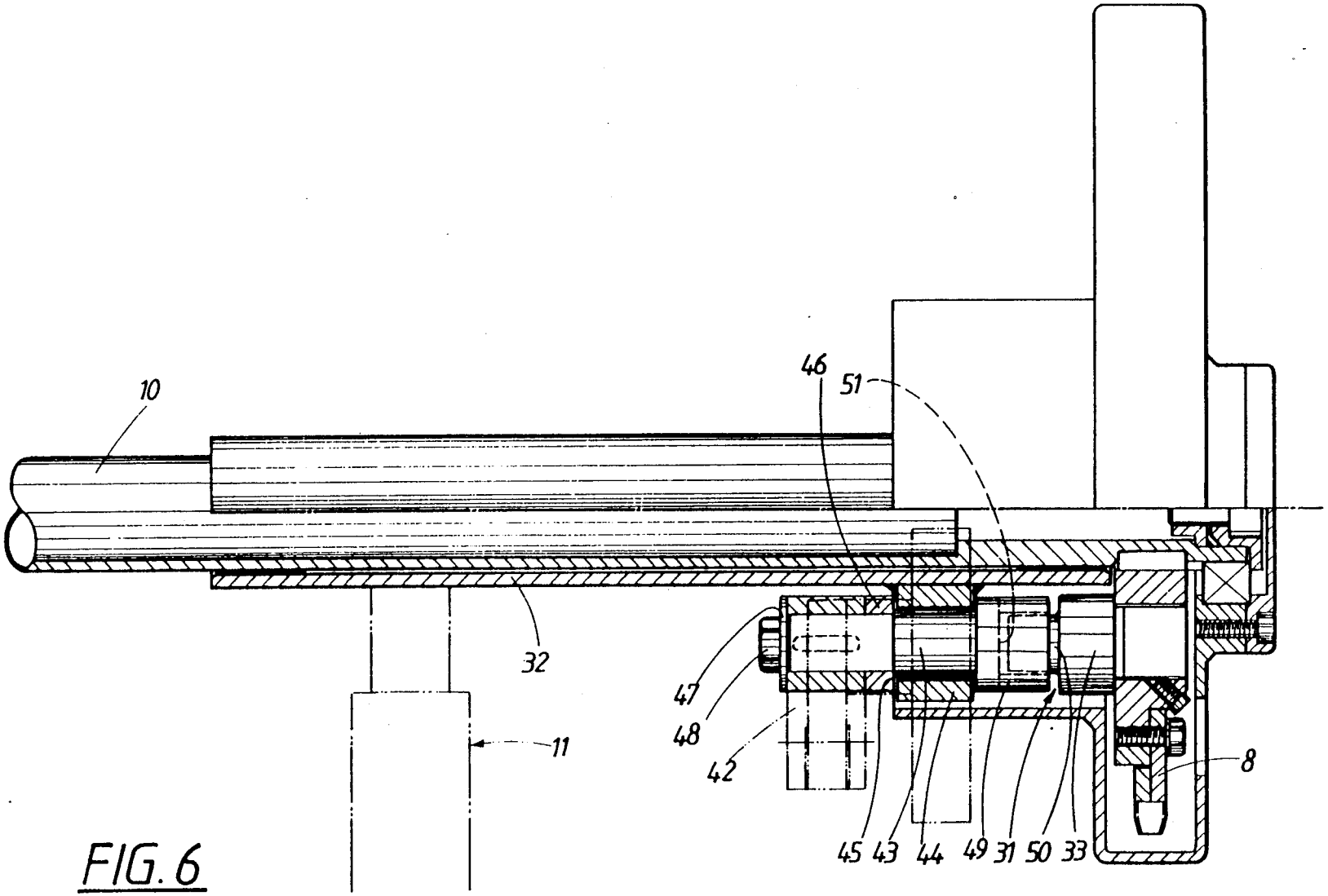
FIG. 6 is a partially broken view in the form of an axial section through a portion of the device according to the invention.

In addition to the lifting device for bringing about the lifting and sinking motion of the receptacle 12, the device according to the invention also includes a receptacle tipping device 31. The tipping device 31 is arranged to tip the cradle 11, and thereby the receptacle, at a predetermined verticle position of the cradle 11 in order to empty the refuse into the collection container 4. As FIGS. 2 and 6 show, the cradle 11 is carried by the axle 10 via a tubular sleeve 32, which encases the axle and extends from each of the two cars 6, 7. The cradle is thereby securely fastened to each of the two tubular sleeves 32, which are arranged so as not to follow the rotational movement of the axle during part of the lifting motion of the axle 9; the cradle is, however, permitted to maintain a certain rotated position relative to the corresponding car 6, 7. The tubular sleeves 32 are, however, not securely attached to the cars, but are permitted to rotate relative to these under predetermined conditions, which are described in more detail below.

The tipping device 31 in the illustrated example consists mainly of a driver 33, which is provided to continuously follow the rotational motion of the wheels, and thereby of the axle 10, and is therefore securely fastened to at least one of the wheels and to a tripping member 34. The tripping member 34 is securely fastened to the tubular sleeve and is provided to be captured by the driver at a predetermined angular position of the driver. In the illustrated example, the driver 33 consists, e.g., of a pin, which sticks out sideways from the wheel 8, whereas the tripping member 34 consists of a sector of a disc, which has two recesses 35, 36, which face away from each other and which are shaped and dimensioned to form stopping surfaces for the pin. The device according to the invention also includes a re-tipping device 37 for the refuce receptacle 12 when it is tipped over into the emptying position. By means of the tipping arrangement 31 the refuse receptacle 12 is tipped to such an extent, that the vertical line through its center of gravity generally passes the longitudinal axis of the axle 10, so that the receptacle does not tip back under its own weight. The re-tipping arrangement 37 has a construction which is partially seen in FIGS. 3, 4 and 5, but which will be described principally with reference to FIGS. 6–9. The re-tipping arrangement is constructed as a linkage system, which is provided to capture the driver when the driver moves in the direction opposite its tipping direction. The linkage system is anchored in a portion, which comprises a part of the hood 6. This portion is designed as a preferably wholly or at least partially enclosing portion 38 in the shape of a flange, fastened to the hood and having a hood member. The flange has a pin 39 which extends parallel to the cross axle 10, on which one end of a first link arm 40 is rotatably journalled. At its other end, the first link arm is rotatably fastened by means of a joint 41 to the one end of a second link arm 42, which, at its opposite ends, is rotatably joined with a joint 43 with an arm 44, which is securely mounted on a tubular sleeve 32. As is best seen in FIG. 6 the joint 43 is formed as an axle, which is rigidly connected with the link arm 42 and which is thus provided to turn along with it. This axle 43 is thereby rotatably journalled in the arm 44. The link arm 42 is, in the illustrated example, mounted on the axle 43 by tensioning it between a sleeve 46, which lies against a shoulder 45 on the axle 43, and a bolt 48 provided with a washer 47. The link arm 42 is disposed on the one side of the arm 44 through which the axle 43 extends and has a coupling member 49 provided to be coupled with the driver 33. The driver 33 is intended to move in a plane which coincides with the plane in which the tripping device 34 is provided to move during the rotation of the sleeve 32.

The driver has an extension member in the shape of a second coupling member 50, which is intended to cooperate with the coupling member 49 of the linkage system and to engage it in certain positions and to be disengaged from it in other positions. The coupling member 50 is formed as a shaft, intended to extend into a recess 51 (see FIGS. 6 and 7) in the coupling member 49. This recess is open in one direction and has an arcuate portion having a curvature which mainly corresponds to that of the shaft 50, and two planar surfaces which diverge from one another in the direction of the opening.

The device according to the invention operates in the following manner. The initial position is shown in the FIGS. 1 and 2, whereby the initial position is represented by the lowest position of the cars 6, 7 as shown in FIG. 1, in which the rear flange 13 of the refuse receptacle 12 is hooked onto the claws 14 of the car 11. The driving device 9 for lifting the axle 10, and thereby the cradle 11, is thereby located in its lower position, i.e., its position of maximum expansion, with the cylindrical member 18, and thereby the inner tube 17, in their lower position, as shown in FIG. 1. The device is activated for causing the lifting motion by causing the piston/cylinders 9 to be forced together by the force from the pressure fluid system, in which the piston/cylinders are included, i.e., the piston in each piston/cylinder arrangement is subjected in a known manner to pressure by controlling the pressure medium using a valve (not shown). The cars 6, 7 thereby follow along in the lifting motion, which causes the wheels 8 to rotate because of their engagement in the driving tracks 26, with the sprocket teeth in the links of the drive tracks' chain links. Because of the non-rotatable coupling of the cross axle 10 to the sprockets 8, the axle follows along with the sprockets during their entire rotational motion, whereby the axle, while maintaining its angle to the horizontal unchanged, is lifted upward and rotates continuously between the two upright units 1, 2.

During a first phase of the lifting motion the tubular sleeve 32 is, however, not carried along in this rotational motion, but rather maintains its angular position relative to the upright units. This means that the cradle 11 also performs a lifting motion during this first phase.

Figure 3:
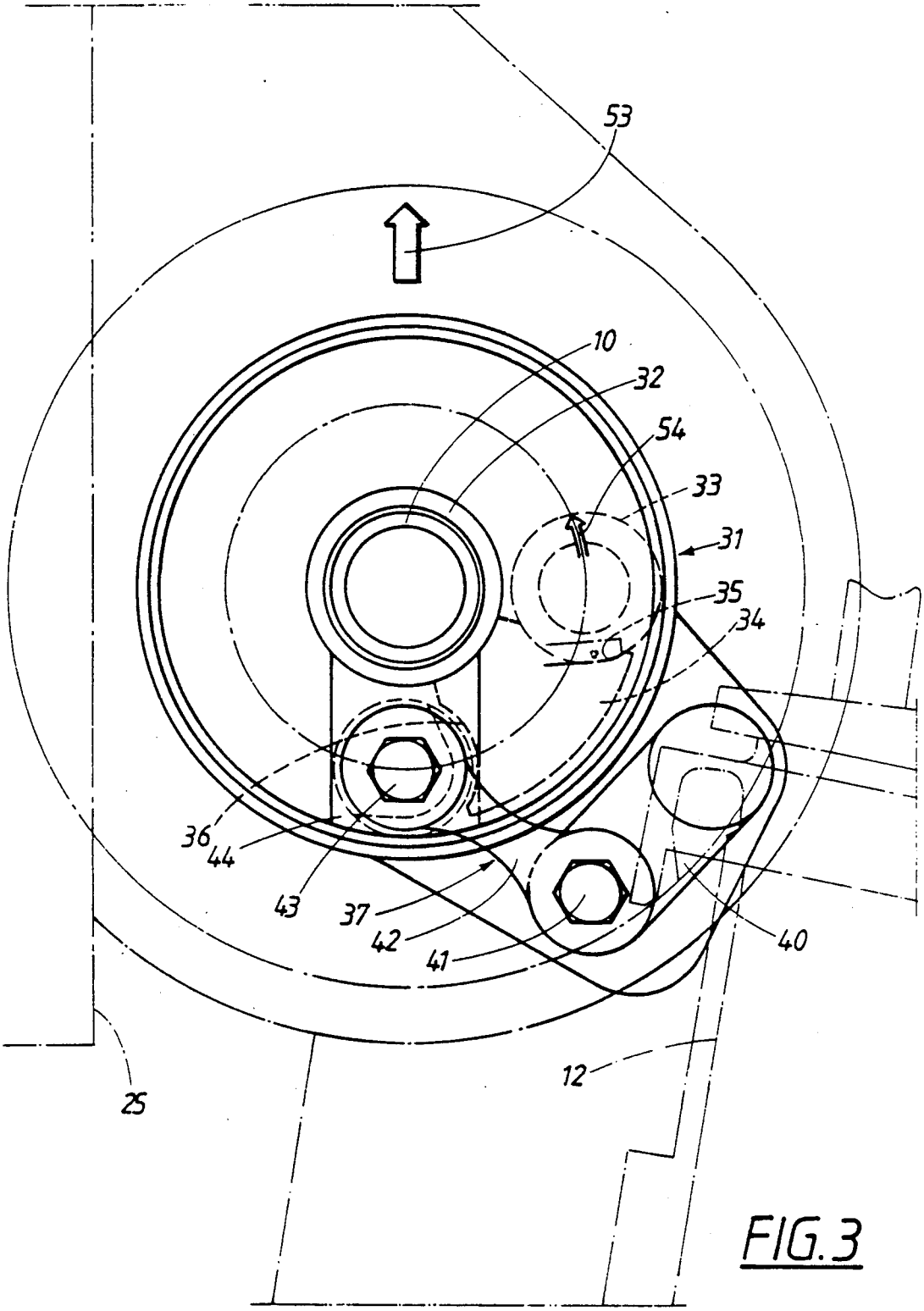
FIGS. 3, 4 and 5 show on a greater scale the receptacle tipping device included in the present invention.
Figure 4:
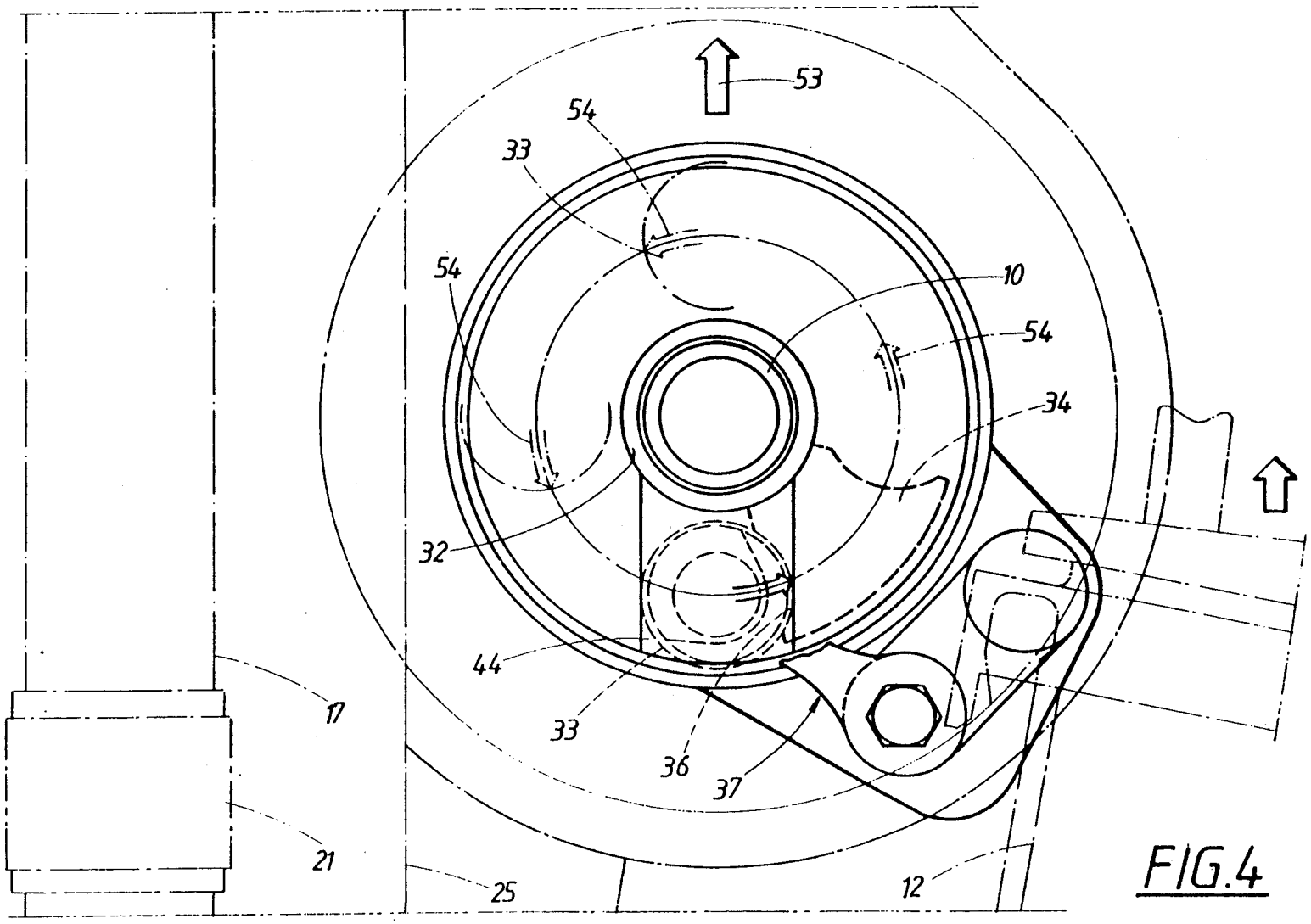

Referring to FIGS. 3 and 4, the reason that the tipping motion has not started will be explained. In the initial position, the tipping arrangment 31 is in the position shown in FIG. 3, whereby the upward lifting direction is shown by an arrow 53, and the direction of rotation during lifting is shown by an arrow 54. In the initial position, the driver member 33 is thus located angularly in front of the tripping member 34, and when the lifting motion has started the driver member 33 is turned counter-clockwise in the direcion of the arrow 54, as is indicated by additional arrows 54 and by two semi-circular contours of the driver member with dash-dotted lines in FIG. 4. During this first lifting phase, the tripping member 34 is thus not influenced by the driver, but rather, as was mentioned above, it maintains its angular position unchanged, as does the cradle and thereby the lifted refuse receptacle 12, which are shown in FIGS. 3 and 4 with an unchanged angular position. This first phase of the lifting motion is completed when the driver 33 has covered a distance of approximately ¾ of a rotation, whereby the driver reaches and contacts the rear contact surface 36 of the tripping member 34. This angular rotation corresponds to a certain movement of the cars along the drive track 26, and thereby the lifting distance of the cradle 11. This lifting distance is carefully matched to the height of the refuse receptacle 12 which is required for tipping it into the chosen collection container 4. This distance is determined by the diameter of the wheels 8 in combination with the angular movement of the driver 33 between the initial position and the final position for the pure lifting motion without tipping, that is, until it contacts the tripping member 34. The driver member 33 and its motion from the one side of the tripping member to the other is also shown in FIG. 1 using schematically drawn symbols. FIG. 1 thus shows the cars drawn in an intermediate position, which constitutes the upper end position of the first pure lifting phase, in which the refuse receptacle 12 is also shown schematically by dash-dotted lines. It may be said that the receptacle still maintains a generally upright position corresponding to the initial position as far as its angular position is concerned, whereas its vertical position thus has been changed.

Since the tubular sleeve 32 and thereby the arm 44 maintain a unchanged rotational position during this first lifting phase, the two link arms 40, 42 of the linkage system also do not change their angular position.

Figure 5:
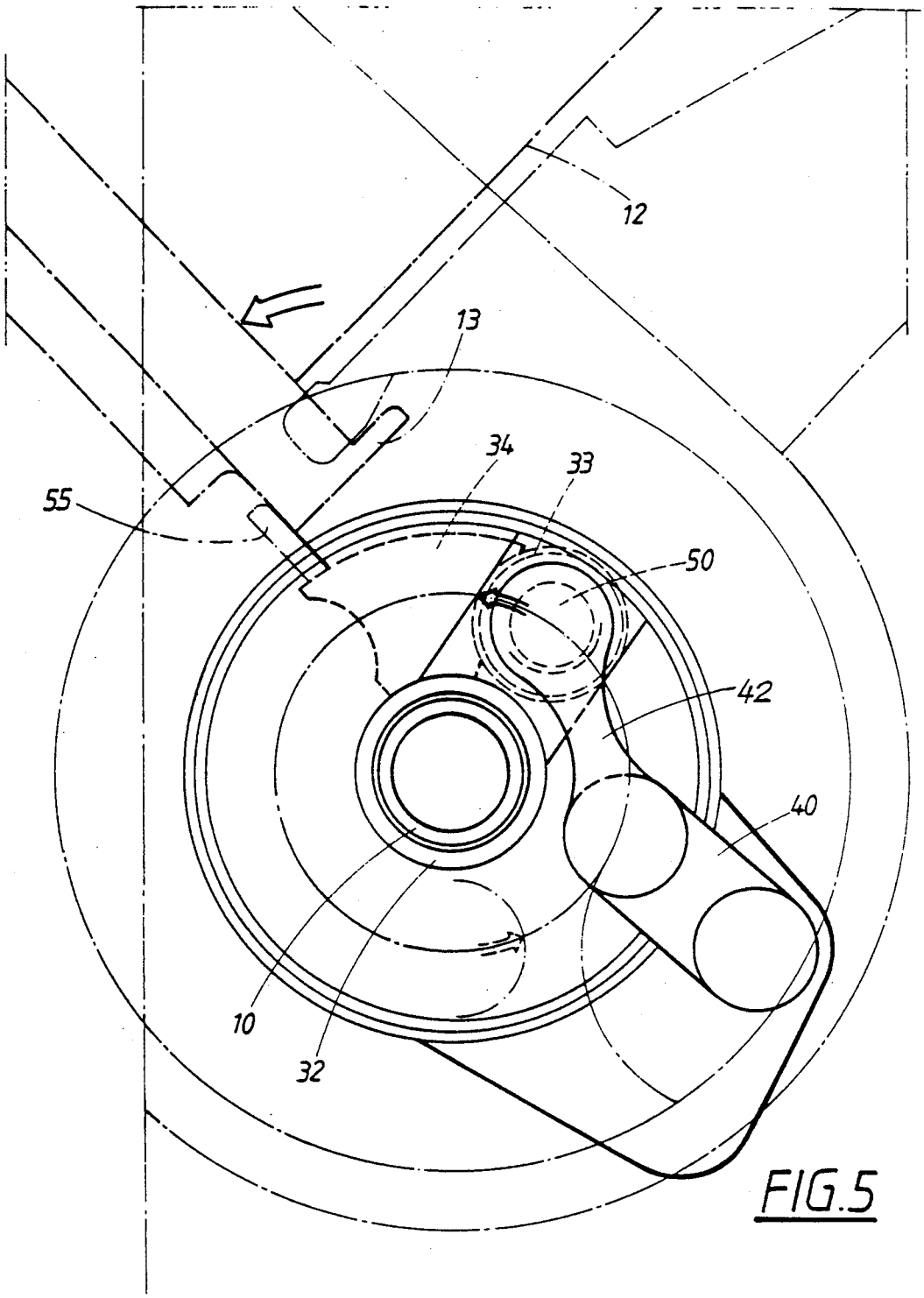

During continued lifting, under the continued influence of the piston/cylinder arrangement 9, by means of the pressure medium for contracting the pistons, the wheels continue their counter-clockwise rotational motion. The driver 33 thereby also continues its counter-clockwise motion from the position shown in FIG. 4, which means that the tripping member 34 is carried along by the driver 33 and is caused to follow along in the rotational motion of the wheels 8. This in turn causes the tubular sleeve 32 and the cradle 11 to leave their hitherto unchanged angular position and to swing along with the turning motion of the axle 10. Even the refuse receptacle 12 is thereby swung around to the tipping postion, as is shown in FIG. 5. The receptacle is held in a secure manner by means of a receptacle capturing device (not shown) and by clamping the receptacle securely at its flange 13 by means of a retractable clamping member 55, which may be of a known type. The lid 56 of the refuse receptacle is suitable arranged with hinges on the sides opposite the suspension point of the receptacle, so that the lid is automatically opened when the receptacle is tipped. The contents of the receptacle may therefore fall into the interior of the collection container under their own weight.

Figure 7:
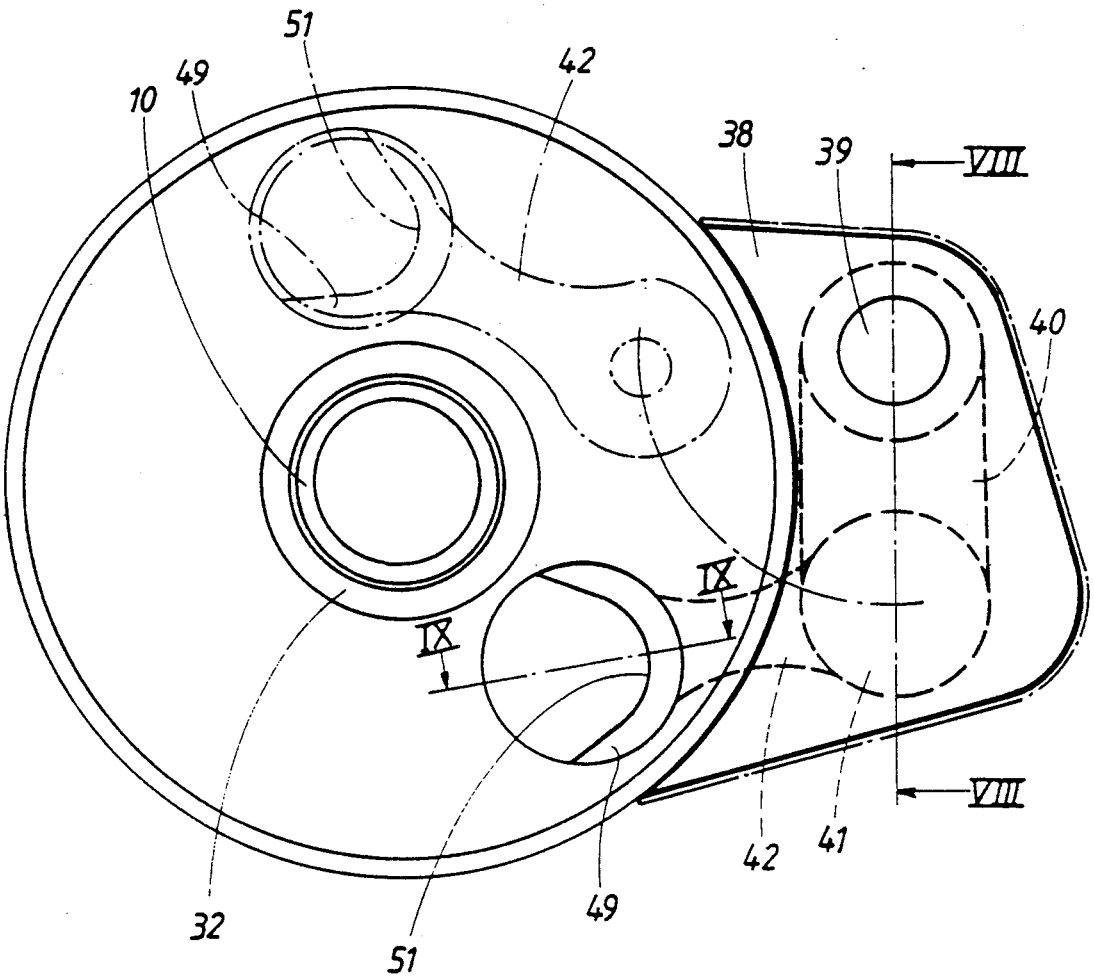
FIG. 7 is a side view of a device for returning the container from a tipped position.
Figure 8:
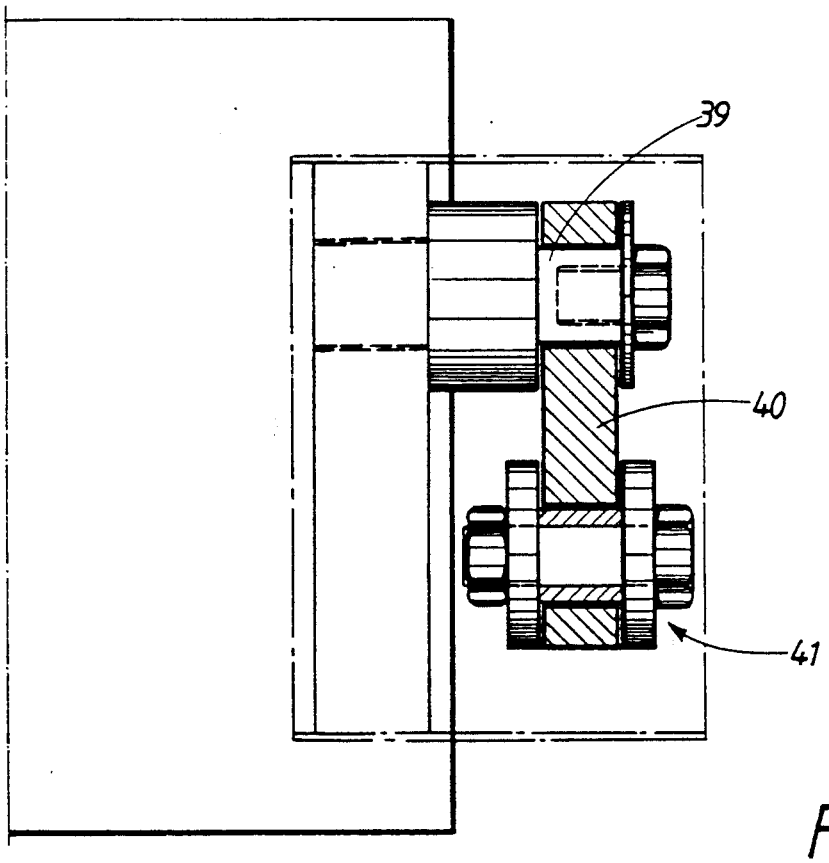
FIG. 8 shows a section taken along the line VIII—VIII in FIG. 7.
Figure 9:
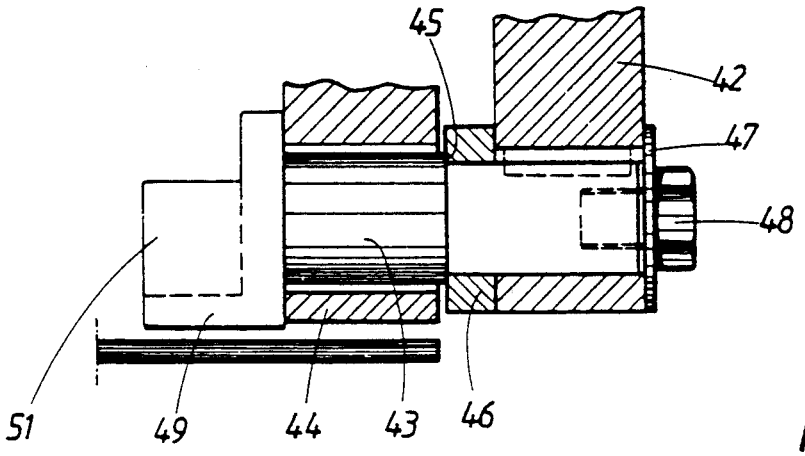
FIG. 9 is a partially broken sectional view taken along the line IX—IX in FIG. 7.

As shown in FIGS. 5 and 7, the linkage system has followed the turning motion of the tubular sleeve 32 during the second phase of the lifting motion, i.e., the combined lifting and tipping motion, having proceeded from the position of the re-tipping arrangement 37 according to FIG. 4. The arm 44, which is coupled to the tubular sleeve 32, thus swings along with the sleeve from the contact position for the driver 43, whereby the joint shaft 33 and thereby the end of the link arm 42 coupled with the joint shaft 43 follow along with the turning motion of the driver 33, whereby the link arm 40 also swings. This means that the desired effect, that, in the tipping position according to FIG. 5 and also FIG. 7, as far as the position of the link arm shown with the dash-dotted lines is concerned, the recess 51 of the coupling member 49, despite a large angular rotation about the cross-axle 10, still maintains its general direction, with a sideways-facing opening to the left in FIG. 7.

Before the final re-tipping of the refuse receptacle 12 and lowering of it to its initial position, a short back-and-forth tipping motion may in many cases be advantageous in order to "shake out" remaining refuse. This is done by means of a reciprocating motion using a maneuvering lever for the pressure medium system. The piston/cylinders 9 are then caused to alternately move a short distance forward and back one or more times in conjunction with the emptying position of the receptacle, whereby the wheels 8 and thereby also the axle 10 and cradle 11 move a short distance back-and-forth. The returning tipping motion, in combination with a sinking motion, is insured by the re-tipping arrangement becoming active. When controlling the pressure medium by means of the maneuvering lever for the piston/cylinders 9, so that these expand, i.e., so that the cylinder member 17 in the illustrated example is lowered, this is accomplished by the wheels 8, due to their engagement in the drive track 26, being caused to be turn clock-wise while moving in the downward direction along the drive track and thereby along the upright units 1, 2. The driver 33 is thereby also turned clockwise from the emptying postition shown in FIG. 5, whereby the direct force on the tripping member 34 ceases. The pinshaped coupling member 50 of the driver 33, however, thereby contacts the coupling member 49 of the linkage system, more precisely, its recess 51 which, via the linkage system, is turned in such a way, that the two coupling members 49, 50 are coupled. This causes the driver 33 in its clock-wise motion to carry via the coupling members 49, 50 the axle 43, the arm 44, the tubular sleeve 32, and the cradle 11 in the return swinging motion, whereby the refuse receptacle is tipped back to a mainly upright position during lowering of the cradle by the lowering motion of the axle 10.

When the driver 33 and the coupling members 49, 50 have reached the position shown in FIG. 4 (see also the position of the coupling member 49 shown with a solid line in FIG. 7), the combined re-tipping and lowering motion will have been completed, whereby the device will have reached the intermediate position shown in FIG. 1. Since the recess 51 of the coupling member 49 is open, still in the direction facing left in FIG. 7, the coupling member 50 of the driver 33 will leave the recess 51 and continue to rotate clockwise about the axle 10 when the driving device 9 continues its sinking motion and the wheels 8 thereby continue to turn clockwise. During this continued turning motion, the axle 45, and thereby the tubular sleeve 32 and the cradle, will thus cease to rotate and will maintain the assumed angular position shown in FIG. 4. The continued sinking motion will be a pure sinking motion, with the refuse receptacle maintained in a generally upright position until the piston/cylinders 9 have reached their fully expanded position, with the cars 6, 7 in their initial position. The emptied receptacle is thereby located close to a base, normally the surface of the ground or a cart for receiving the receptacle.

The invention may be summarized thus: The cross-axle 10 for tipping the refuse receptacle is subjected to a force directed transverse to the axle and the axle is caused to rotate by the wheels at both ends of the axle rotating through contact with a track, whereby the wheels are non-rotatably fastened to the axle. The cradle, which carries the refuse receptacle, is rotatably journalled on the axle in such a way that the cradle is provided not to be carried along in the turning motion of the axle during a certain period, but in another period to be carried along in its turning motion. The tipping arrangement ensures disengagement between the cradle and the axle during the pure lifting and lowering phase, and a non-rotatable coupling between the cradle and the axle during the combined phase, with lifting and lowering during tipping.

The invention is not limited to the exemplifying embodiment described above and shown in the drawings, but may be varied within the scope of the following patent claims. As was mentioned above, it is for example conceivable for the driving device to be provided in only one of the upright units, i.e., that the piston/cylinder is left out of the other upright unit. A smooth lifting and lowering movement is nonetheless ensured due to the synchronous motion of the two wheels along their respective drive tracks. Even if the piston/cylinders are provided in both of the upright units it is conceivable that the tipping arrangement 31 and also the re-tipping arrangement 37 will be provided in only one of the cars 6, but in other cases it may be suitable to provide a tipping arrangement and a re-tipping arrangement in both of the cars 6, 7.

It is also conceivable that the tipping motion is slowly started at the same time as the lifting motion. Furthermore, in certain cases, two or more receptacles may be lifted at the same time, held next to each other. The wheels 8 may be of another type which provides engagement in the drive track, e.g., pinions, whereby the drive track consists of a rack.

The above-described inner tubes 17 may in principle be left out, whereby the cars 6, 7 are mounted directly on the cylinder members 18, which are thereby also provided with the gliding linings 21, 22; alternatively, the outer curved surface of the cylinder member may form the support and gliding surface of the outer tube.

We claim:

1. A refuse handling device for moving a refuse receptacle (12) between a lower level and a higher level and for emptying the receptacle at the higher level by tipping the receptacle, including a cradle (11) provided to carry at least one receptacle, a driving arrangement (9) for lifting and lowering the cradle, two upright units and a means (21) for turning the cradle between an upright receptacle position and a receptacle emptying position, comprising:

an axle (10), carrying the cradle, the axle being raisable and lowerable transverse to a longitudinal direction, and rotatable;

the axle has wheels (8) at its ends which are non-rotatably connected with the axle;

each of the wheels rotatably journalled in a respective car (6, 7), each of the cars being provided to run in a respective elongated guide arrangement (25);

at least one of the cars driven by said driving arrangement (9) by said at least one car being subjected to a force which is generally directed in a longitudinal direction of the guiding arrangement for causing said lifting and lowering motion;

each of the wheels being in contact with and engaged by a respective drive track (26) which extends along a corresponding guide arrangement, the wheels being caused to rotate by engagement with said track and by an effect of said force on at least one of the cars for turning the axle during its rising and lowering motion in such a way that the rising and lowering motion of the axle takes place during parallel displacement of the axle; and the cradle coupled with said axle via a cradle tipping means (31), said cradle (11) being rotatably journalled on said axle, so that the cradle only performs a limited turning motion together with the axle, whereby the cradle and thereby the refuse receptacle are tipped at said higher level from a generally upright position at said lower level, said cradle tipping means (31) including a driver means (33), adapted to constantly turn together with the wheels (8), and a tripping member (34), provided to turn together with the cradle, wherein said driver means is provided to carry said tripping member along with it over a predetermined angular interval of a turning motion of the driver means; and said two upright units (1, 2), each provided to be mounted on a respective side of an opening (3) into a collection container (4), and in that each of the upright units carries said guide arrangement (15), said driving arrangement and said drive track (26), said driving arrangement includes a piston/cylinder arrangement comprising an immobile member and a mobile member and controlled by a pressure medium and secured by said immobile member in one end of the upright unit, each car being securely connected with the movable member of each piston/cylinder arrangement, each movable member being guided along an upright unit.

2. Device according to claim 1, wherein said tipping means includes a means for maintaining the cradle in an unchanged angular position relative to the guide arrangement during a first angular interval of the turning motion of the wheels, and thereby during a first phase of lifting the cradle from the lower level, and to rotate the cradle through a second angular interval during a second phase of the lifting of the cradle.

3. Device according to claim 1, wherein the cradle (11) is securely jointed with at least one tubular sleeve (32), with which said tripping member (34) is securely joined, and in that said driver means (33) is securely joined with at least one of the wheels (8).

4. Device according to claim 1, further comprising said upright units (1, 2) arranged as outer tubes (16) each with a cylindrical channel which forms a guide for an inner tube (17), on which said cars (6,7) are securely mounted, and which move up and down by the driving arrangement (9), and said piston-cylinder arrangement secured with a member (19) in one end (20) of the outer tube, whereby the inner tube is securely joined with a second member (18) of the piston/cylinder.

5. Device according to claim 4, wherein a piston rod end (19) of the piston/cylinder (9) is mounted in an upper end of the outer tube (16), whereby the inner tube (17) is joined with a cylindrical member (18) of the piston or consists of an integral part of the piston.

6. Device according to claim 1, wherein the drive track (16) consists of a chain (5) extending along an outer tube (16), the wheels (8) consist of sprockets for engaging the links of the chain, and the outer tube has an elongated slit (24) through which the cars (6, 7) extend.

* * * * *